US005161693A

United States Patent [19]

Friman

[11] Patent Number: 5,161,693

[45] Date of Patent: Nov. 10, 1992

[54] CARCASS CARGO HANDLING

[75] Inventor: Erik A. Friman, Danderyd, Sweden

[73] Assignee: Cool Carriers Svenska AB, Danderyd, Sweden

[21] Appl. No.: 663,870

[22] PCT Filed: Oct. 26, 1989

[86] PCT No.: PCT/SE89/00597

§ 371 Date: Apr. 2, 1991

§ 102(e) Date: Apr. 2, 1991

[87] PCT Pub. No.: WO90/04540

PCT Pub. Date: May 3, 1990

[30] Foreign Application Priority Data

Oct. 27, 1988 [AU] Australia ..... PJ 1191

[51] Int. Cl.[5] ..... B65B 25/00

[52] U.S. Cl. ..... 206/597; 206/600; 220/9.2; 220/404; 426/393; 426/396; 53/399; 53/440; 53/469

[58] Field of Search ..... 206/386, 597, 600, 83.5; 220/9.2, 404, 403, 401; 426/124, 129, 393, 396; 53/399, 459, 440, 469

[56] References Cited

U.S. PATENT DOCUMENTS

| | | | |
|---|---|---|---|
| 2,042,288 | 5/1936 | Bach et al. | 220/9.2 X |
| 2,315,001 | 3/1943 | Logan | 220/9.2 X |
| 2,913,029 | 11/1959 | Paton | 220/401 |
| 3,741,260 | 6/1973 | Kocay | 426/129 X |
| 3,813,467 | 5/1974 | Drain | 426/393 |
| 3,983,258 | 9/1976 | Weaver | 426/129 X |
| 4,221,296 | 9/1980 | Fell et al. | 206/600 |
| 4,299,365 | 11/1981 | Battle | 220/9.2 X |
| 4,512,473 | 4/1985 | Thomaswick et al. | 206/600 X |

FOREIGN PATENT DOCUMENTS

| | | |
|---|---|---|
| 81276/82 | 4/1986 | Australia . |
| 315544 | 9/1969 | Sweden . |
| 380497 | 11/1975 | Sweden . |
| 1299724 | 12/1972 | United Kingdom . |
| 1443824 | 7/1976 | United Kingdom . |

*Primary Examiner*—Paul T. Sewell
*Assistant Examiner*—Jacob K. Ackun, Jr.
*Attorney, Agent, or Firm*—Merchant, Gould, Smith, Edell, Welter & Schmidt

[57] ABSTRACT

The present invention relates to a carcass carrying cargo unit and a method of transporting carcasses using said unit, comprising a bag (13) open at one end, a frame structure (16) comprising a base frame (18) and two upright (19) end frames and strapping means (9) whereby in use said frame structure (16) is placed within said bag (13) with its opening between the end frames facing to one side of the frame structure (16), and where the carcasses are loaded into said bag (13) onto said base frame (18) to the approximate height of side frames (19), the opening (15) of the bag is drawn tight and the strapping (9) means engaged around the thus loaded bag to secure the carcasses in the bag.

17 Claims, 5 Drawing Sheets

CARCASS CARGO HANDLING

The present invention relates to a carcass carrying cargo unit and a method of transporting carcasses using said unit.

Australia exports a large volume of carcasses, mutton, lamb and beef, and beef fore and hind quarters. The existing methods of storage and handling have involved a high degree of "manhandling" of the carcasses.

After the animal is processed at the meat works, the soft carcasses are hung in frames and transported to the coldstore blastfreezers where they are deep frozen. After blastfreezing, the deepfrozen carcasses are removed by hand and stacked in open ended frames, in which the carcasses are stored until loading on the ships for export.

The carcasses are then transported in the said frames by refrigerated truck to the ship for loading where the carcass loaded frames are loaded aboard the ship where the carcasses are removed from the frames and hand stowed and the frames dismantled and returned ashore for return to the coldstore.

When the ship reaches its destination the carcasses have to be loaded by hand into a sling or a similar frame unit for transportation ashore. The present invention seeks to lessen the manhandling of the carcasses by providing an improved carcass cargo unit.

In one broad form the invention comprises a carcass carrying cargo unit comprising:

a bag open at one end;

a frame structure comprising a base frame and two upright end frames; and strapping means;

whereby in use said frame structure is placed within said bag with its opening between the end frames facing to one side of the frame structure, and where the carcasses are loaded into said bag onto said base frame to the approximate height of the side frames, the opening of the bag is drawn tight and the strapping means engaged around the thus loaded bag to secure the carcasses in the bag.

Preferably the bag unit has lifting sling means fixed thereto, and is of total dimensions so as to be held in a standard loading frame unit.

In another form the invention comprises a method of handling carcasses, comprising the steps of:

a) blastfreezing the carcasses;

b) placing within a jig, comprising a base and two end uprights one of which is demountable or pivotally connected to the base frame, a bag having its open mouth facing to the side of the jig with the top edges of the bag supported from the jig;

c) placing within the thus held open bag a stiffening frame structure comprising a base member and two upright end members;

d) loading the carcasses into the bag onto the stiffening base frame to the approximate height of the upright end members;

e) drawing tight the open mouth of the bag; and f) strapping around the thus loaded bag to secure the loaded carcasses therein, wherein the bag can be lifted by crane or forklift.

In a further form the invention comprises a jig for holding a carcass cargo unit which comprises an open bag with a stiffening frame comprising a base and two upright members.

Preferably the bag is of dimensions to be held by a standard loading frame unit.

The invention will now be described by way of example with reference to the accompanying drawings in which.

Figure 1:
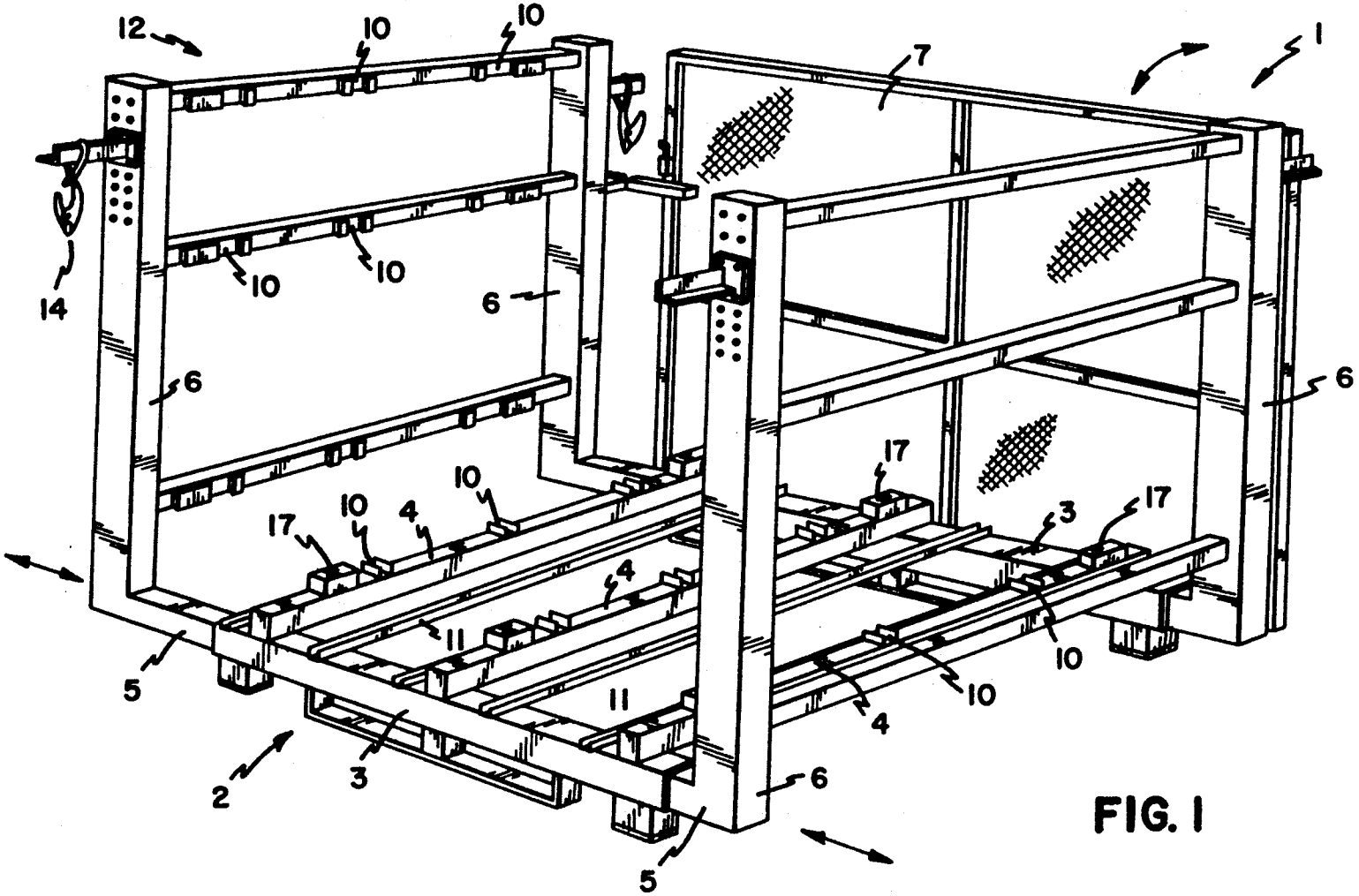
FIG. 1 illustrates a jig for holding the bag and frame structure of the cargo unit in one embodiment of the present invention.
Figure 2:
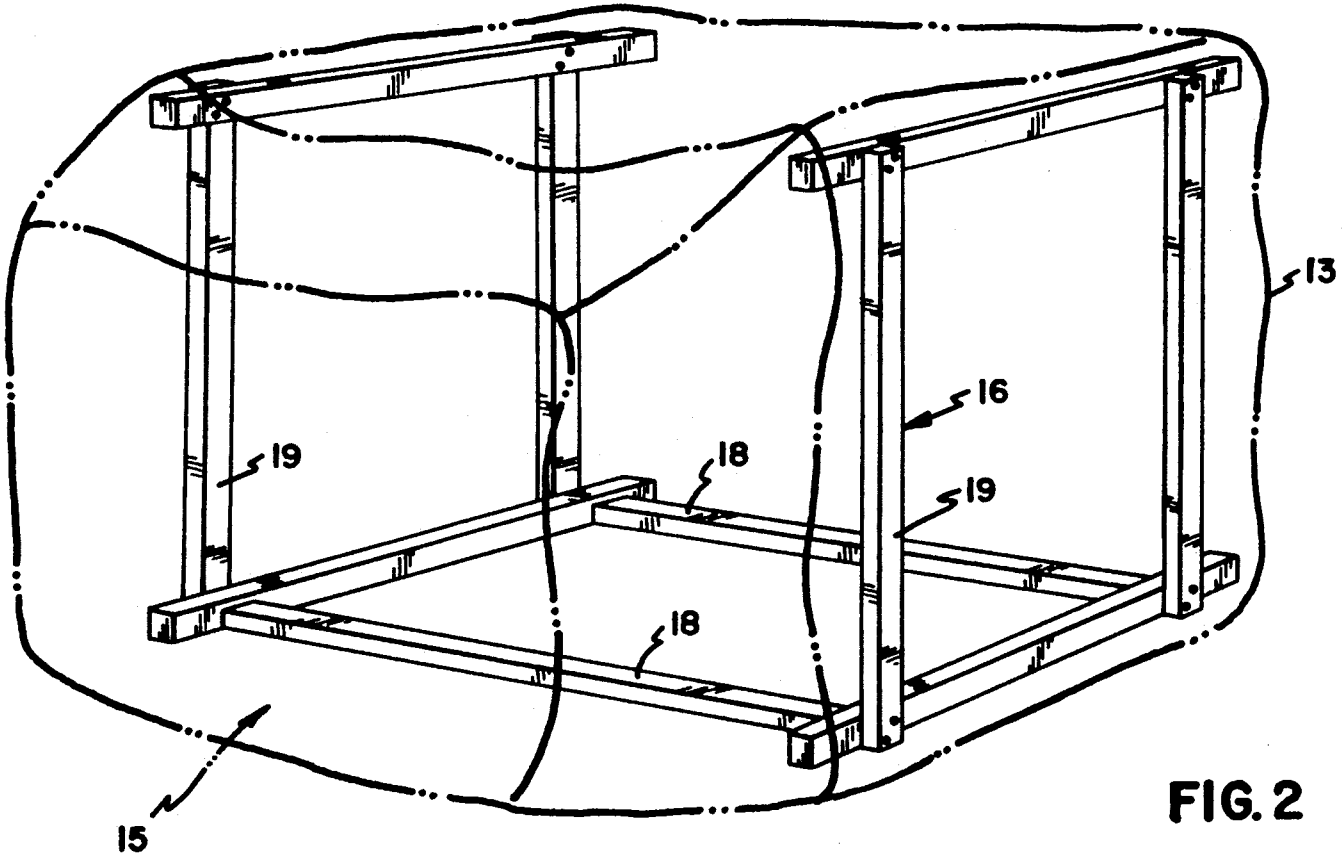
FIG. 2 illustrates one embodiment of the frame structure of the carcass cargo carrying unit of the present invention with the bag unit shown in broken lines.

A jig 1 for loading of carcasses is shown in FIG. 1. This comprises a lower frame 2 consisting of two elongated members 3 connected to each other by transverse profiles 4 and having elongated members 5 telescopically movable in the ends thereof. The elongated members 5 may be hingedly connected to a pair of uprights 6 at one end but such uprights may also be rigidly connected to both ends of such members. Connectable to the jig 1 is a planar end members door like member 7 arranged as a rear abutment surface at the jig 1.

The transverse support profiles 4 connected to the elongated members 3 form openings allowing the insertion of a fork of a forklift above the lower frame members to engage and lift a loaded carcass cargo units from the jig. Further the jig 1 has forklift loops located below the elongated members 3 to assist in moving the jig by forklift.

One set of straps (not shown) is arranged to be laid along guides 10 on the lower frame 2 transverse profiles 4 and on transverse profiles of uprights 6 and a further set of transverse straps (not shown) laid in continuous strap guides 11 in parallel with profiles 4.

Figure 3:
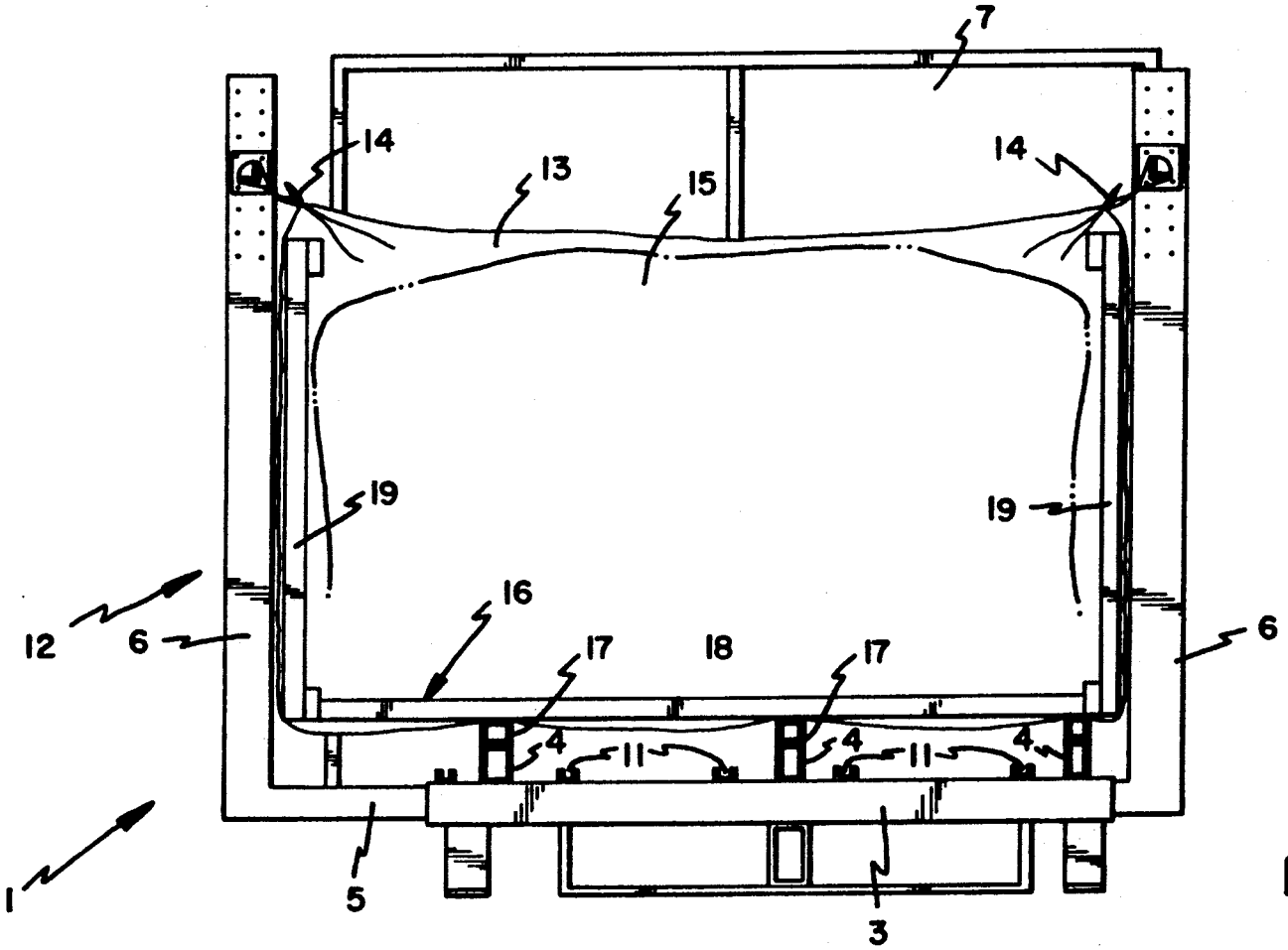
FIG. 3 shows the position of one embodiment of the carcass cargo unit positioned lin the jig illustraged in FIG. 1.

A stiffening frame 16 shown in FIG. 3 is to be placed within a bag 13 which can be of any suitable material such as plastics. The frame 16 is preferably made from wood, and comprises two longitudinal members 18 affixed to two side frames 19 comprising two wooden uprights and appropriate crossmembers.

FIG. 3 shows how the bag 13 is inserted into and connected onto the jig of FIG. 1 by securing the upper bag portion by clamps and braces 14 to the jig uprights, with the open mouth 15 of the bag facing the free side of the jig, and with the stiffening frame 16 inside the bag resting on top of raised projections 17 secured top the transverse profiles 8.

Figure 4:
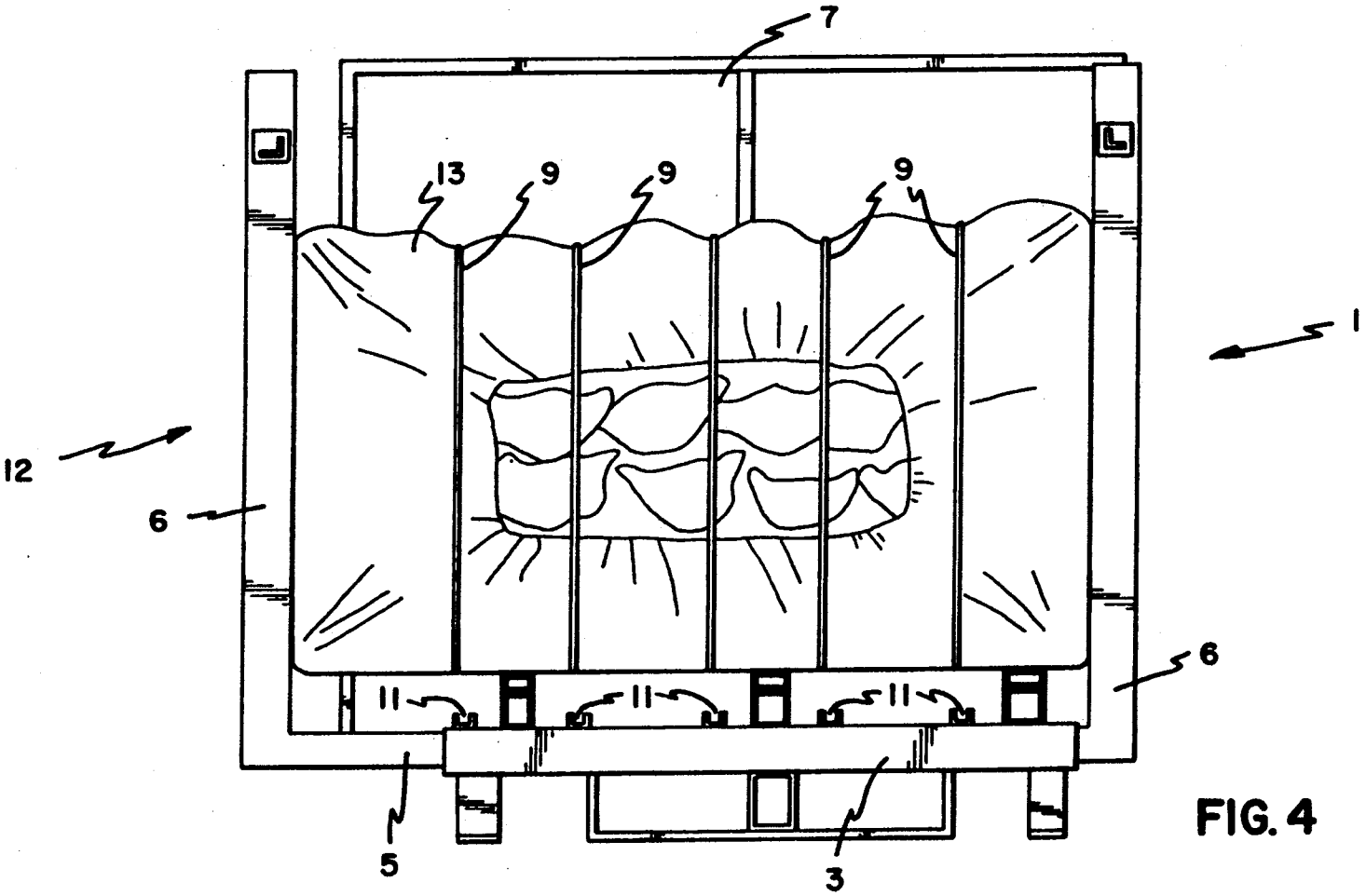
FIG. 4 shows the fully loaded carcass cargo unit in the holding jig with the envelopping bands secured in position around the bag and its contents.

With the unit as set up, as shown in FIG. 4, the carcasses are stacked lengthwise across the elongated frame members 3 of the stiffening frame to abut against the rear door like support member 7. The jig itself can be tilted by any means such as electric or hydraulic lifting devices to ensure tight stacking. The bag is then filled to the height of or above the stiffening frame side frames 19 and the open mouth 15 of the bag is then drawn tight and secured.

The set of straps resting in the guides 10 and the set of straps 9 resting in the guides 11 are then tightened one in each direction around the bag as shown in FIG. 4 to securely hold the carcasses in position. The fork of a forklift can easily engage under the carcass cargo unit so enclosed and strapped for lifting and for transporting of the carcass cargo unit from the jig 1 to other handling means.

The bag may include lifting straps 20 sewn or otherwise secured to the bag material—such that the carcass carrying unit can after being removed from the jig 1 and tilted 90 may be lifted by any crane or the like.

Figure 5:
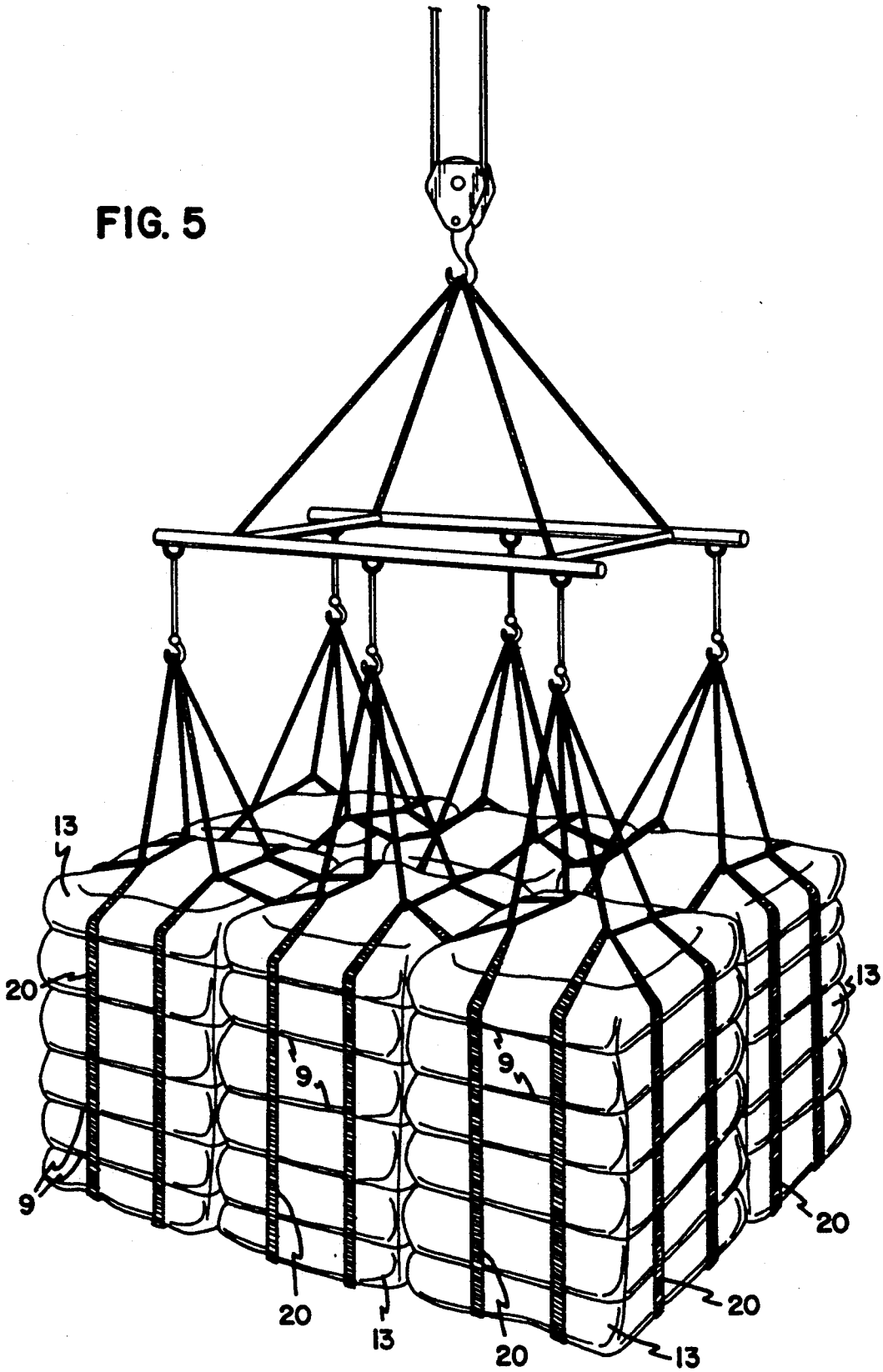
FIG. 5 illustrates schematically six loaded bags being lifted from a common lifting bar arrangement after having been tilted.

FIG. 5 shows how a number of bags are arranged and hooked onto a lifting bar. The six bags are thus arranged to be lifted in a single lift.

Ventilation holes are provided on two sides of the bag to assist in the flow of air through the stacked carcasses.

Thus, once the carcasses have been loaded into and secured in the cargo units bags, there is no more "manhandling" of the individual carcasses, during transportation or storage. In transportation the carcass cargo units are positioned with the ventilation holes on the top and bottom to provide an efficient flow of cold air to keep the carcasses frozen.

The carcass cargo units can be of any suitable size, but preferably have the width of the length of the carcass to be handled. A typical size is 2 meters long by 1.5 meters high by 1.10 to 1.40 in depth. Further the units can be stored and transported on either their bases or sides and self-contained bases could be attached through the bag to the stiffening frame to avoid the use of separate pallets. An added feature of the present invention is that the bag is additional protection against staining and pollution during transportation and storage.

It should be obvious to people skilled in the art that modifications and alterations can be made to the cargo unit and packaging method described above without departing from the scope or spirit of the present invention.

I claim:

1. A method of packing objects in a bag, the bag having a mouth, comprising the steps of:

a) providing a jig having a plurality of sides including a jig base and two upright ends, at least one upright end being movable with respect to the jig base and at least one side of the jig being generally open, the jig having bag securing means proximate at least one of the open sides;

b) placing the bag within the jig so that the mouth of the bag is facing the open side of the jig, the mouth being held open by the bag securing means;

c) placing within the held open bag a stiffening frame, the frame having a frame base and two upright frame ends;

d) loading and stacking objects to be packed into the bag on top of the frame base between and to the approximate height of the upright frame ends;

e) releasing the bag securing means and closing the mouth of the bag; and f) applying strapping means around the loaded bag and frame to secure the loaded objects therein, thereby forming a stable unit which can be lifted by a crane or forklift.

2. The method according to claim 1 wherein the loaded bag is of dimensions such that it can be held within the dimensions of a standard cargo pallet or frame unit.

3. The method according to claim 1 further including the steps of:

g) providing arranged guides on the jig in both the lateral and transverse directions; and h) laying the strapping means in the guides before placing the bag within the jig.

4. The method according to claims 1 including the step of connecting a removable substantially planar door-like support member to the jig proximate the side opposite to the mouth of the bag placed in the jig, the planar support member being arranged to form an abutment means for loading and stacking the objects inside the bag.

5. The method according to claim 1 wherein the objects are irregularly shaped.

6. The method as claimed in claim 1 wherein the objects are frozen animal carcasses.

7. The method of claim 1 including the step of moving the movable end of the jig to facilitate removal of the loaded and strapped bag.

8. A cargo unit containing a plurality of bagged objects comprising:

a bag having a closable opening at one end;

a frame having a frame base and two upright frame ends located inside the bag, the objects being packed into the bag on top of the frame base between and to the approximate height of the upright frame ends; and strapping means surrounding the bag, the frame and the objects contained therein, whereby the cargo unit is stabilized by the interaction between the bag, the frame, the objects and the strapping means.

9. The cargo unit of claim 8 wherein the objects are irregularly shaped.

10. The cargo unit of claim 8 wherein the objects are frozen animal carcasses.

11. The cargo unit of claim 8 wherein the bag includes lifting slings.

12. A jig having a plurality of sides for forming a cargo unit containing objects, the cargo unit including objects stacked in a stiffening frame contained within a bag, the bag having an mouth, comprising:

a jig base having two elongated base members and a plurality of elongated transverse members mutually connecting the two base members forming underlying supports for the stiffening frame, the jig base having a first and second end;

first and second upright ends, the first upright end being movably attached to the first end of the base to allow adjustment of the distance between the two upright ends and the second upright end being attached to the second end of the base, at least one side of the jig being generally open; and securing means located on the first and second upright ends proximate the generally open side, operable to hold the closable mouth of the bag in the open position proximate the generally open side.

13. The jig of claim 12 wherein both upright ends are movably attached to their respective ends of the elongated members.

14. The jig of claim 12 wherein guide means are located on the jig to temporarily position fastening means which are to be tightened around the cargo unit to secure the loaded objects.

15. The jig of claim 12 wherein at least one of the upright ends is telescopically movable with respect to the elongated base members to allow adjustment of the distance between the two upright ends.

16. The jig of claim 12 wherein the space between the upright ends is generally the same size as the dimensions defined by standard cargo pallets or frames.

17. The jig of claim 12 wherein a generally planar member is connected to one of the sides of the jig opposite the open side and the open mouth of a bag, the support member being arranged to form an abutment means for loading and stacking the objects inside the bag.

* * * * *

UNITED STATES PATENT AND TRADEMARK OFFICE

CERTIFICATE OF CORRECTION

PATENT NO. : 5,161,693

DATED : November 10, 1992

INVENTOR(S) : Erik A. Friman

It is certified that error appears in the above-indentified patent and that said Letters Patent is hereby corrected as shown below:

In column 4, claim 4, line 5, delete "claims" and insert --claim-- therefor.

Signed and Sealed this

Eleventh Day of January, 1994

*Attest:*

*Attesting Officer*

BRUCE LEHMAN

*Commissioner of Patents and Trademarks*